US005884794A

United States Patent [19]

Calhoun et al.

[11] Patent Number: 5,884,794

[45] Date of Patent: Mar. 23, 1999

[54] BULK CONTAINER ASSEMBLY

[75] Inventors: Wallace E. Calhoun, Hurley; William A. Burrell, Ocean Springs, both of Miss.; James Lee Toney, Martinez, Calif.; Rick L. Adams, Pascagoula, Miss.; Mark B. Rittiner, Gulf Breeze, Fla.; Jim C. Huffman, Theodore, Ala.

[73] Assignee: Chevron U.S.A. Inc., San Francisco, Calif.

[21] Appl. No.: 963,369

[22] Filed: Nov. 3, 1997

Related U.S. Application Data

[60] Provisional application No. 60/030,392 Nov. 5, 1996.

[51] Int. Cl.[6] ..... B65D 87/00

[52] U.S. Cl. ..... 220/1.5; 410/54; 105/355

[58] Field of Search ..... 220/1.5; 410/54; 105/355, 359

[56] References Cited

U.S. PATENT DOCUMENTS

| | | | |
|---|---|---|---|
| 3,907,147 | 9/1975 | Goobeck | 220/1.5 |
| 3,971,491 | 7/1976 | Mowatt-Larssen et al. | 220/1.5 X |
| 4,809,873 | 3/1989 | Fossey | 220/1.5 X |
| 5,069,352 | 12/1991 | Harbolt | 220/1.5 |
| 5,167,341 | 12/1992 | Morton et al. | 220/346 |
| 5,198,398 | 3/1993 | van Duijn | 220/1.5 X |
| 5,265,748 | 11/1993 | Furukawa | 220/1.5 |
| 5,647,514 | 7/1997 | Toth et al. | 220/1.5 X |

*Primary Examiner*—Steven Pollard
*Attorney, Agent, or Firm*—Timothy J. Hadlock

[57] ABSTRACT

A transportable cargo container for transporting bulk volumes of cargo, some of which may be hazardous material, including: a rectangular floor member and roof member having the same dimensions; an opening in the roof member for the introduction of the cargo; a support channel attached to the roof member for increasing the structural strength of the roof member; and wall members extending therebetween having lengths the same as the floor member; where the floor, roof, and wall members are attached by continuous-seal welds; a hatch member for each of the openings in the roof member for sealing the openings; a flexible gasket positioned around the perimeter of the side of the hatch most proximate to the roof member for preventing leakage of the cargo out of the hatch when closed; a door located in an end wall for the removal of the cargo; a latch attached to a central portion of the door for sealing the door; where the latch comprises an extendible wedge member for engagement with a portion of the wall member immediately adjacent to the door; a flexible gasket disposed around the perimeter of the side of the door most proximate to the wall member, for preventing leakage of the cargo out of the door when the door is in the closed position; at least one pressure fitting in the floor, roof, or wall members for removable attachment to a pressure testing line; and at least one pressure release/vacuum breaker device attached to the roof member.

18 Claims, 5 Drawing Sheets

BULK CONTAINER ASSEMBLY

CROSS-REFERENCE TO RELATED APPLICATIONS

This application claims priority from U.S. Provisional Application Ser. No. 60/030,392, filed Nov. 5, 1996.

FIELD OF THE INVENTION

The present invention relates to a bulk container assembly. The present invention especially relates to a cargo container of the type suitable for transport on a container vessel or railroad flat car and which is adapted for removable attachment to a truck. Such containers frequently are referred to as "MATSON" and "SEA LAND" containers. It particularly relates to an apparatus and method which can adapt and utilize such a container for the transport of hazardous solids and liquids.

BACKGROUND OF THE INVENTION

There are many types of cargo which require shipment by a combination of truck and rail, truck and ship, or a combination of all three to reach their designated marketing areas. Most existing methods of handling such products, i.e., loading, handling and unloading, are generally inefficient and costly. In addition, they frequently require specialized equipment at points of transfer.

In recent years, containerized ships have been developed which are adapted to transport dry-bulk or packaged cargo held in specially designed containers. The containers are provided with loading and dumping hatches so they may be filled with a dry-bulk commodity, such as a particulate material, or access doors for filling with boxes, barrels and the like. The containers are then transported by rail or truck to the dockside where they are loaded onto the ship. This does away with the need for special bins or holds in the ship and for elaborate loading and unloading procedures, since the cargo remains in the container and is transported therein until it reaches its ultimate destination.

The transportation of a liquid cargo represents a more complex problem. For large bulk quantities of a liquid, such as oil, special ships or tankers have been designed which also require special loading and unloading facilities. For smaller quantities, it is possible to transport a liquid in tanks or canisters. Typically, however, such tanks or canisters have a relatively small capacity and require special handling procedures. Further, the weight of the tanks or canisters relative to that of the liquid contained therein is relatively high with the associated additional shipping expense. Moreover, if the ship to be utilized is containerized and adapted to carry a dry-bulk load in containers, the same ship is not ordinarily suited for liquid loads unless special facilities are provided.

The transportation of hazardous material (including hazardous waste) requires specialized containers. Most importantly, the specialized containers should be adapted such that there is no identifiable release of the hazardous material to the environment under conditions normally incident to transportation of the hazardous materials. Various governmental transportation and environmental laws and regulations govern the requirements for such containers for shipping hazardous material. Previously known containers for shipping hazardous material are small drums, barrels, or so-called intermediate bulk containers. The large number of the known containers required causes high handling, labeling, and shipping costs. The requirement to inspect numerous small containers for leakage also causes high costs associated with using such containers.

Pressure tanks are known for shipping liquids. Such tanks generally have small openings. Small openings cannot be used for loading or unloading solids or sludges.

There exists a need for a larger shipping container for transporting larger volumes of hazardous solid, liquid, and sludge cargo wherein the volume of cargo is not sufficient to warrant a special vessel and transfer facilities, but which is too great for practical shipment in barrels or canisters.

SUMMARY OF THE INVENTION

The invention includes a container assembly or apparatus and a method of transporting cargo using the container assembly. The apparatus aspect of the invention is a transportable cargo container for transporting a bulk volumes of a solid or liquid cargo, which container includes:

a) a substantially rectangular floor member;

b) a substantially rectangular roof member having substantially the same dimensions as the floor member, having at least one support channel fixedly attached to the roof member or integral thereto extending across at least a portion of the width of the roof member, for increasing the structural strength of the roof member;

c) and wall members extending therebetween having lengths substantially the same as the floor member and having a substantially equal heights;

d) where the floor member, roof member, and wall members are fixedly attached by continuous-seal welds along the entire perimeter of the floor member, roof member, and wall members;

e) the floor member, roof member, and wall members defining an enclosure;

f) at least one opening in the roof member for the introduction of the cargo;

g) a hatch member for each of the openings in the roof member for sealing the openings:

i) the hatch member having a width and depth not less than the width and depth of the opening in the roof member; and ii) where one edge portion of the hatch means is pivotably attached to one edge portion of the opening in the roof member;

h) hatch member attachment means attached to the roof member or hatch member for maintaining the hatch member in the closed position;

i) flexible gasket means disposed around the perimeter of the side of the hatch means most proximate to the roof member for preventing leakage of the cargo out of the hatch means when closed;

j) door means located in one of the end wall members for the removal of the cargo;

k) latch means fixedly attached to a central portion of the door means for sealing the door means; where the latch means includes an extendible wedge member for engagement with a portion of the wall member immediately adjacent to the door means;

l) flexible gasket means disposed around the perimeter of the side of the door means most proximate to the wall member, for preventing leakage of the cargo out of the door means when the door means is in the closed position;

m) at least one pressure fitting means in the floor, roof, or wall members for removable attachment to a pressure testing line; and n) at least one pressure release/vacuum breaker device fixedly attached to the roof member for releasing any excess pressure and reducing any excess vacuum in the container.

The invention also includes the method of transporting cargo as described below:

a) providing a container as described above;

b) filling the container to desired level with the cargo;

c) closing the container; and d) transporting the container by a transport vehicle to another location.

These and other aspects of the invention and advantages to be obtained therefrom will be more apparent from the detailed description which follows.

DETAILED DESCRIPTION OF THE PREFERRED EMBODIMENTS

A. Elements

Figure 1:
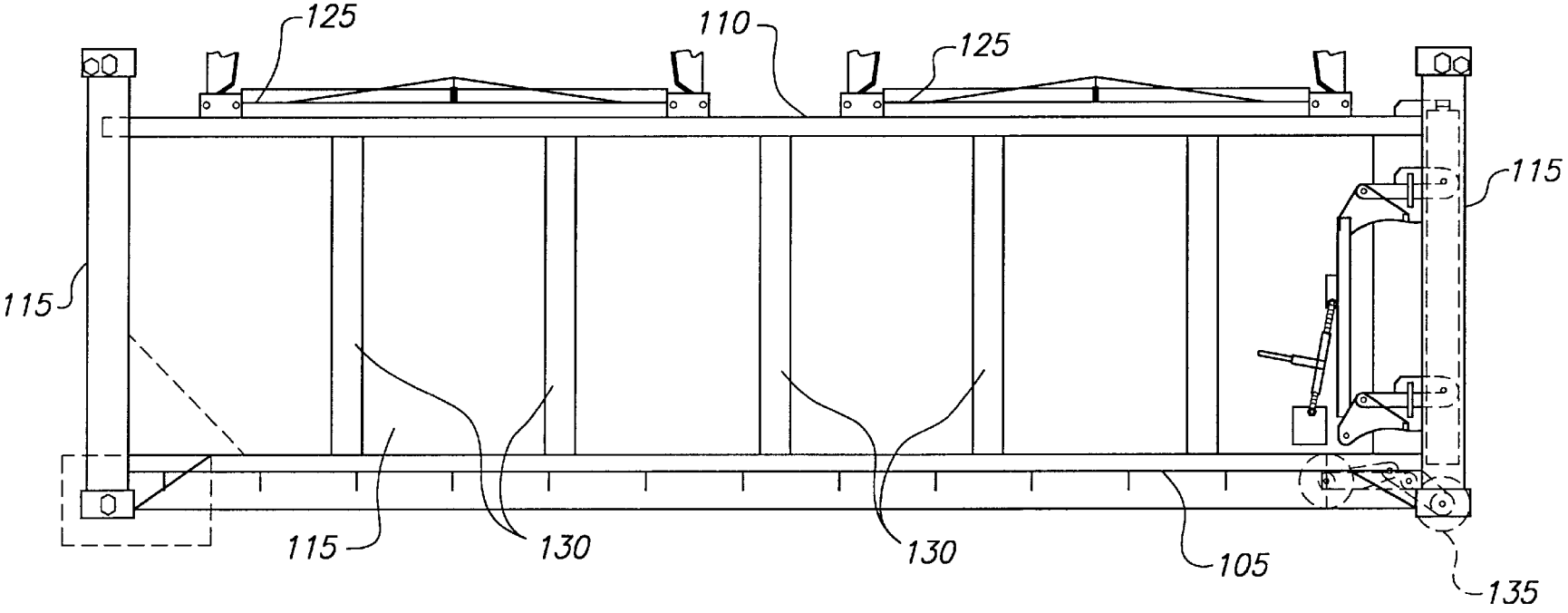
FIG. 1 depicts a side elevation view of one embodiment of the container of the invention.
Figure 2:
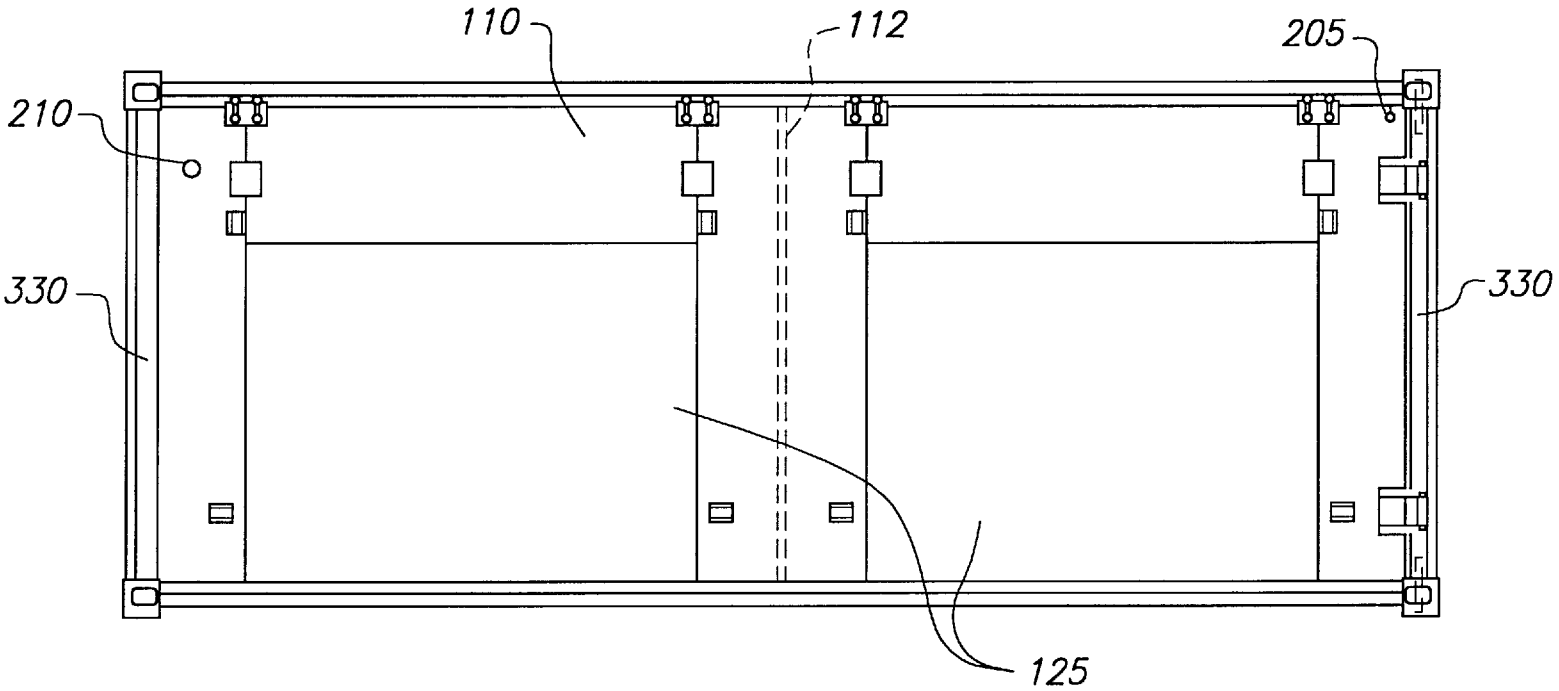
FIG. 2 depicts a top plan view of one embodiment of the container of the invention.
Figure 3:
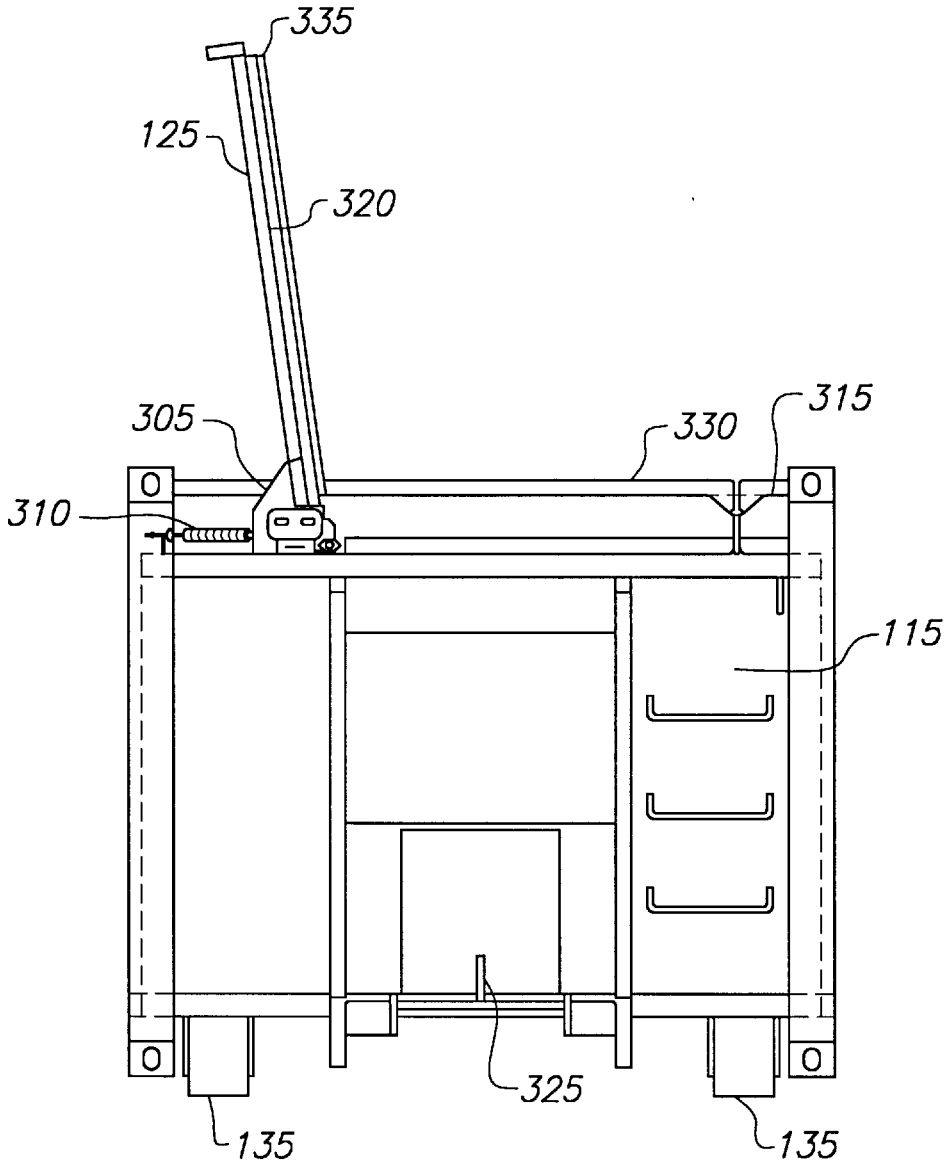
FIG. 3 depicts a front elevation view of one embodiment of the container of the invention.

The elements for the container assembly and corresponding reference numbers are listed in Table 1 below. In the section following this one, each element and how it relates to the other elements is described in detail with reference to the figures. The reference numbers were selected so that the first digit corresponds to the first figure in which the element clearly appears. For example, roof member 110 first appears in FIG. 1. Although the roof member appears in later figures, it is numbered 110 in all figures since it is the same element.

TABLE 1

| Element Name | Element Number Used In Figures |
|---|---|
| A floor member. | 105 |
| A roof member. | 110 |
| At least one support channel. | 112 |
| Wall members. | 115 |
| A four-sided hatch member. | 125 |
| At least one rigid elongated arm member. | 305 |
| A helical tension spring member. | 310 |
| Hatch-member attachment means. | 315 |
| Flexible gasket member. | 320 |
| Four-sided door member. | 405 |
| Latch member. | 505 |
| Gasket member. | 410 |
| Attachment means. | 325 |
| A plurality of substantially vertical integral rib members. | 130 |
| At least one pressure fitting means. | 205 |
| At least one pressure release/vacuum breaker device. | 210 |

TABLE 1-continued

| Element Name | Element Number Used In Figures |
|---|---|
| An elongated stacking bar. | 330 |
| At least two wheel members. | 135 |
| A layer of a fluid-impervious synthetic material. | 335 |

B. Organization of Elements In the Assembled Container

The container of the invention includes a substantially rectangular floor member 105, a substantially rectangular roof member 110, having substantially the same overall dimensions as the floor member 105, and wall members 115 extending therebetween. The dimensions of the floor member 105, roof member 110, and wall members 115 are chosen so as to meet size and weight requirements of the applicable shipping and transportation, environmental, and any other applicable laws and regulations for the location and manner in which the containers will be used. For example, the applicable size regulations for containers only used for trucking may in some localities be more flexible than containers used for intermodal usage. The volume of the enclosure defined by floor member 105, roof member 110, and wall members 115 will correspond to the chosen dimensions of those members.

The dimensions of some embodiments of floor member 105 and roof member 110 are shown in Table 1. In these embodiments, the wall members 115 have lengths substantially the same as the floor member 105 and have a heights as shown in Table 1. In this embodiment, the floor member 105, roof member 110, and wall members 115 define an enclosure having volumes as shown in Table 1.

The floor member 105, roof member 110, and wall members 115 are fixedly attached by any conventional method which provides a leak proof seal as required to meet the applicable shipping and transportation, environmental, and any other applicable laws and regulations in the locality and manner in which the containers will be used. For example, some applicable regulations are found in 49 C.F.R. §§172, 173, and 180.407(g). These regulations include those relating to shipping cargo under the DOT hazard class 4.2 relating to self-heating materials. These regulations include provisions designed to implement the underlying policy that containers for transporting such hazardous materials must be designed, constructed, and filled so that under conditions normally incident to transportation there will be no release of hazardous material to the environment. In particular, the regulations provide that the container must be able to transport liquids without leaking. This can be demonstrated by pressure testing the container to show it can maintain a constant 3 psig pressure for 5 minutes. It has been found that continuous-seal welds along the entire perimeter of the floor member 105, roof member 110, and wall members 115 will meet these pressure requirements. However, other conventional construction and sealing techniques may be used if available.

It is necessary to have an opening in one of the members of the container for introducing the cargo. The roof member 110 is preferable since an opening there is most easily accessed by loading equipment, it would result in the least number of spills upon loading, and is mostly easily sealed. In one embodiment, there is at least one four-sided opening in the roof member 110 for the introduction of the cargo. The opening is typically defined by portions of the roof member 110. Optionally, the opening need not be fully defined by the portions of the roof member 110. That is, for example, two sides of the opening may be defined by portions/edges of the top member 110 parallel to longitudinal end portions of top member 110. A large cut-out or notch in top member 110 may allow for another one or two sides of the opening to be defined by top portions of the wall members 115. Variations of this may exist so that three sides of a four-sided opening are defined by roof member 110 and one side of the four-sided opening is defined by a top portion of a wall member 115.

In one embodiment, there is one or two openings, each of a size sufficient to allow loading of cargo from a standard-sized front-end loader. In one embodiment, the opening is a four-sided opening and has a width as shown in Table 1.

The roof member 110 is fabricated so as to be able to meet any necessary pressure-bearing requirements. Such fabrication optionally includes incorporation of integral or fixedly attached strengthening ribs or channels. In one embodiment, there is at least one support channel 112 fixedly attached to roof member 110 or integral thereto. It optionally extends across at least a portion, and preferably all, of the width of the roof member 110. Such a support channel 112 will facilitate meeting any needs for increased structural strength of the roof member 110.

Any conventional hatch means is included for sealing the opening, e.g., in the roof member 110. In one embodiment, a four-sided hatch member 125 is included for each of the openings in the roof member 110 for sealing the openings. The hatch member 125 has a width and depth not less than the width and depth of the opening in the roof member 110. One edge portion of the hatch member 125 is pivotably attached to one edge portion of the opening in the roof member 110. The pivotably attachment means is any conventional pivoting attachment device, such as hinges.

Hatch member 125 is optionally structurally reinforced by conventional strengthening means, such as ribbing, support channels, or bracing. A flexible gasket member 320 is optionally disposed around the perimeter of the side of the hatch member 125 most proximate to the roof member 110. It is needed for preventing leakage of the cargo out of the hatch member 125 when closed. The gasket member 320 is chosen from a material having sufficient flexibility and sealing properties to provide any necessary pressure sealing requirements; and having sufficient durability and toughness to avoid failure between scheduled maintenance or replacement times.

Where the hatch member 125 is large enough to allow front-end loading of cargo and strong enough to maintain any necessary pressure requirements, the hatch member is likely to be heavier than is convenient for one person to safely open and close. Optionally, there is any conventional mechanical or hydraulic weight bearing means attached to the hatch member 125 for facilitating safe opening and closing the hatch member 125 by one person. In one such embodiment of a weight-bearing facilitating means, there is at least one rigid arm member, e.g., elongated or triangular, having first and second end portions. The first end portion is fixedly attached to or near the edge portion of the hatch means which is pivotably attached to one edge portion of the opening in the roof member 110.

A helical tension spring member 310 having two end portions is then included for bearing at least a portion of the weight of the hatch member 125 when opening and closing the hatch member 125. One end portion of the spring member 310 is fixedly attached to the second, raised, end portion of the arm members; and the opposite end portion of the spring member 310 is fixedly attached to the roof member 110. The configuration of attachment should be one resulting in the spring member 310 bearing at least a portion of the weight of the hatch member 125 when opening and closing the hatch member 125. In this way, typically, when the hatch member 125 is in the closed position, the springs will be in the extended or stretched position.

Hatch-member attachment means 315 are attached to the roof member 110 or hatch member 125 for maintaining the hatch member 125 in a closed position. Such means include any conventional mechanisms for securely closing a hatch.

For example, a bolt may be hingedly attached at one end to roof member. The hatch member 125 could have notches on one edge for receiving the bolt members. Oversized "wing" nuts could then be threaded on the bolt for maintaining the hatch member in the closed position.

Removal of the cargo can be done through the same opening in the roof member 110 as is used for introducing the cargo. Typically, however, it is preferable to have an opening in one of the longitudinal end walls 115. With such an opening, the cargo can be unloaded "dump-truck" style by opening this end wall opening and raising the opposite longitudinal end of the container. This opening is typically in the rear end wall member 115. The opening in the end wall 115 may be a conventional door or hatch. For example, the entire rear end wall 115 may be hinged. The hinging is on any one edge portion of the end wall 115, e.g., top, bottom or side portion. Each manner of hinging has various advantages. Hinging at the top is typically preferable since this best simulates the "dump-truck" style.

Optionally, a four-sided door member 405 is located in one portion of the end wall members 115 for the removal of the cargo. The door member 405 has dimensions chosen as needed to facilitate removal of the cargo when in the open position while preventing leakage of the cargo while in the closed position. In one embodiment, the door width is as shown in Table 1. Conventional strengthening means, such as ribbing or channeling, is optionally integral to or fixedly attached to the door member 405.

In one embodiment, a latch member 505 is fixedly attached to a central portion of the door member 405 for increasing its sealing strength in the closed position. The latch member 505 optionally includes an extendible wedge member 510 for engagement with an "eye" portion 515 of the wall members 115 or floor member 105 immediately adjacent to the door member 405. Typically, there is an aperture or "eye" portion 515 integral to or fixedly attached to the wall members 115 or floor member 105 for receipt of the extendible wedge member 510.

Another second flexible gasket member 410 is disposed around the perimeter of the side of the door member 405 most proximate to the wall members 115. The second flexible gasket member 410 is for preventing leakage of the cargo out of the door member 405 when the door member 405 is in a closed position. The second gasket member 410 is chosen from a material having sufficient flexibility and sealing properties to provide any necessary pressure sealing requirements and sufficient durability and toughness to avoid failure between scheduled maintenance or replacement times.

Attachment means 325 is fixedly attached to, or integral to, the floor member 105, disposed on an end of the container opposite the end of the container incorporating the door member 405. The attachment means 325 is typically an eyelet for receipt of a hook and is for removable attachment of the container assembly to a vehicle. Preferably, there are a plurality of substantially vertical integral rib members 130 in the wall members 115 for adding structural strength to the wall members 115.

In order to test the container for pressure bearing capacity there is at least one pressure fitting means 205 in the floor member 105, roof member 110, or wall members 115 for removable attachment to a pressure testing line. Typically, pressure fitting means 205 is in roof member 110 since this minimizes risk of leakage of the cargo through it. Since the cargo may vaporize, there is at least one pressure release/vacuum breaker device 210 fixedly attached to floor member 105, the roof member 110, or wall members 115 for releasing any excess pressure and reducing any excess vacuum in the container.

To meet part of the stackability requirements for intermodal containers, there is an elongated stacking bar member 330 fixedly attached, or integral to, each lengthwise end of the roof member 110. The stacking bar members 330 provide a surface for stacking two or more containers on one another. Each stacking bar member 330 extends across substantially the full-width of the roof member 110. Also, each stacking bar member 330 is elevated from the roof member 110 above the hatch member 125 and hatch-member-attachment means 315.

At least two wheel members 135 are rotatably attached to floor member 105 at the end of the container proximate to the door member. Wheel members 135 are for rolling the end of the container proximate to the door member 405 along a surface on which the container rests when the opposite end of the container is attached by the attachment means to a vehicle. Typically, there are also two sets of rollers (or wheels) that are attached under the front end of the floor member 105. These are optionally used to reduce friction between the container and a truck when loading the container on to a truck.

Figure 4:
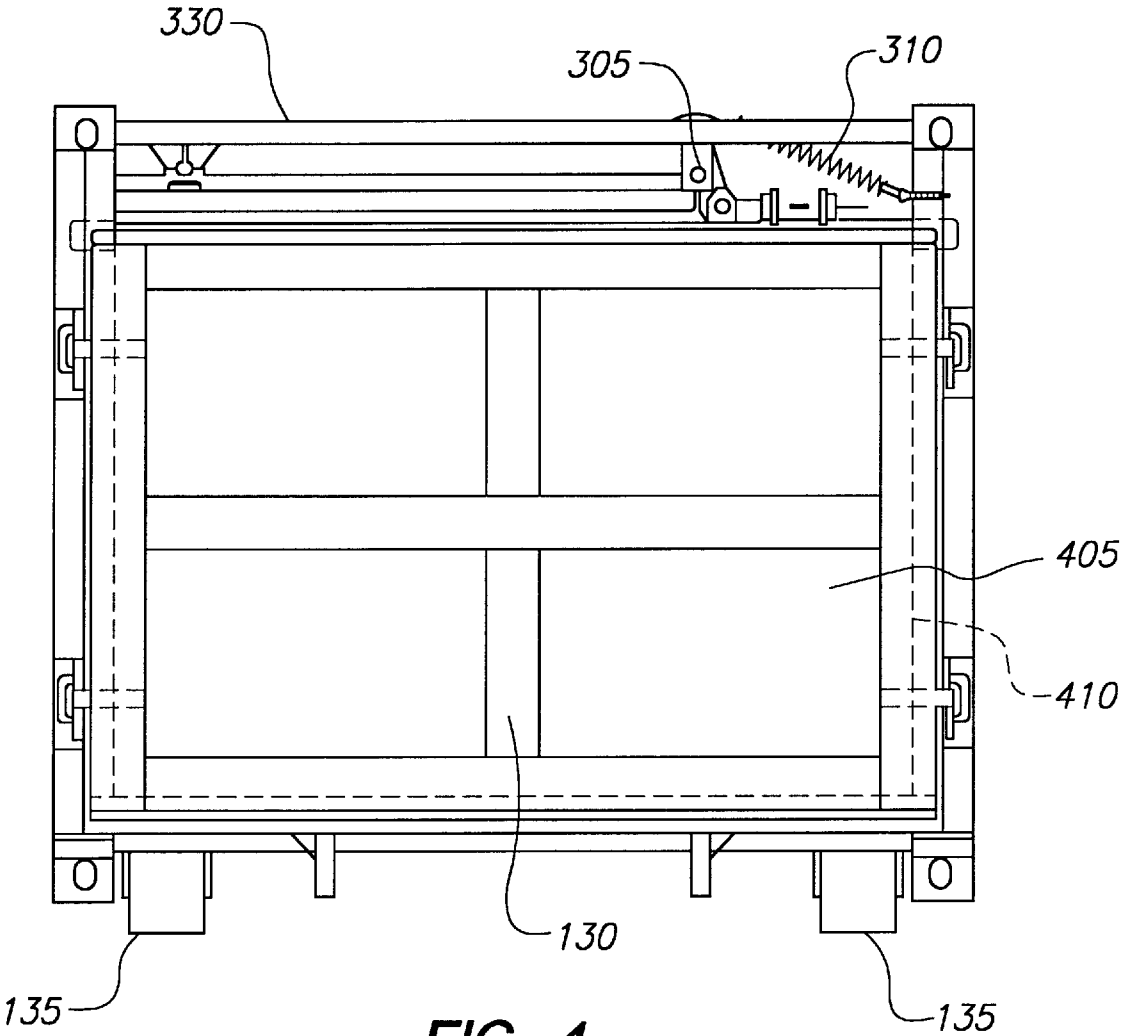
FIG. 4 depicts a rear elevation view of one embodiment of the container of the invention.
Figure 5B:
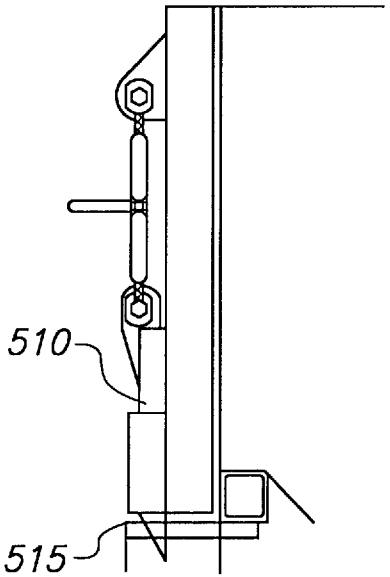
FIG. 5B depicts a side elevation portion view of one embodiment of the latch member and door means elements of one embodiment of the container of the invention.
Figure 5A:
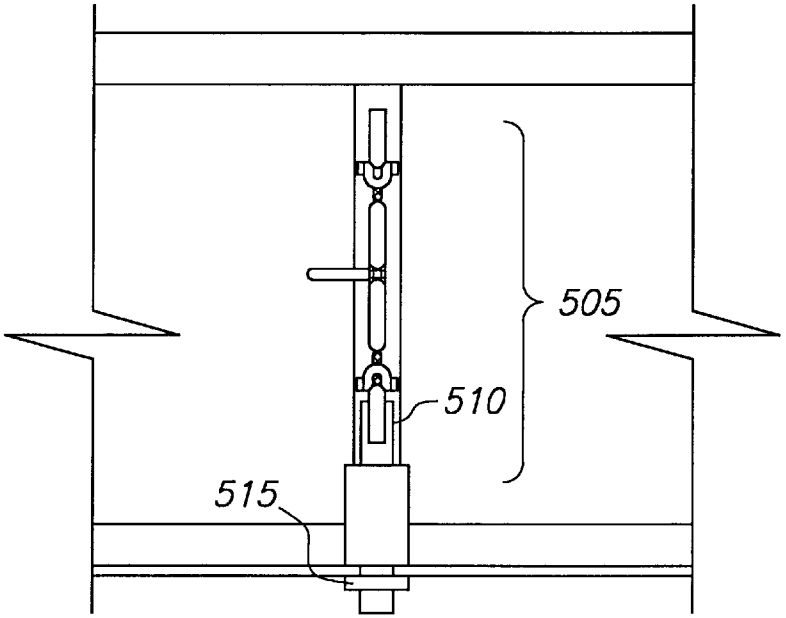
FIG. 5A depicts a rear elevation portion view of one embodiment of the latch member and door means elements of one embodiment of the container of the invention.

The sides of the floor member 105, roof member 110, and wall members 115 proximate to the enclosure formed by the floor member 105, roof member 110, and wall members 115 are optionally layered with a fluid-impervious synthetic material. Such a layer 335 (shown in FIG. 4 on the inner side of the four-sided hatch member as representative of a layer on the entire inner, and optionally outer surfaces, of the various members) can reduce corrosion and wear on the container assembly.

C. Dimensions

The main dimensions of some embodiments of the container of the invention are shown in Table 2 below.

TABLE 2

| | Non-Intermodal Embodiment | | Intermodal Embodiment | |
|---|---|---|---|---|
| Range | Broader | Narrower | Broader | Narrower |
| Length (ft./inches) of: floor member 105, roof member 110, wall members 115 | 10'–40' (3.33–13.33 yds.) | 22'–24' (7.33–8 yds.) | 12'–30' (4–10 yds.) | 19'–21' (6.33–7 yds.) |
| Width (ft./inches) of: floor member 105, roof member 110 | 4'–13' (1.33–4.33 yds.) | 6'9"–7'3" (2.25–2.42 yds.) | 4'–12' (1.33–4 yds.) | 7'9"–8'3" (2.58–2.75 yds.) |
| Height (ft./inches) of wall members 115 | 30"–120" (0.83–3.33 yds.) | 40"–62" (1.11–1.72 yds.) | 40"–110" (1.11–3.06 yds.) | 45"–60" (1.25–1.67 yds.) |
| Volume of Enclosure (cubic yards) | 4–192 | 18–33 | 6–122 | 20–32 |
| Tare weight of container (lbs.) | 4000–16000 | 8000–8400 | 5000–12000 | 7900–8100 |
| Width of Top Hatch member 125 (ft./inches) | 4'–18' | 6'–8' | 5'–14' | 6'–8' |
| Depth of Top Hatch member 125 (ft./inches) | 3'–12' | 4'–6' | 2'–11' | 4'–7' |

TABLE 2-continued

| | Non-Intermodal Embodiment | | Intermodal Embodiment | |
|---|---|---|---|---|
| Range | Broader | Narrower | Broader | Narrower |
| Width of four-sided door 405 (ft./inches) | 4'–13' | 6'9"–7'3" | 4'–12' | 7'9"–8'3" |
| Height of four-sided door 405 (ft./inches) | 30"–120" | 40"–62" | 40"–110" | 45"–60" |

D. Other

It is an essential feature of the present invention that the container be a substantially rigid structure. By "substantially rigid", it is meant that the container, when filled to design or maximum capacity with the fluid to be transported, be capable of holding its shape. Some lateral deformation or bulging is to be expected. Indeed, the container ideally will have a minimum wall thickness to reduce its weight and thereby permit the maximum amount of cargo to be transferred. A minimum wall thickness will result in some bulging or flexing of the wall members.

It is a particular advantage of the present invention that, while the container may be specially constructed, a standard shipping container also may be modified to obtain the container of the invention. One method of manufacturing the container of the invention is to modify a conventional "MATSON" or "SEA LAND" type of container. Such containers are commercially available and provided with means for removable attachment to a vehicle for land transport as well as stacking on a containerized shipping vessel. When modifying an existing container to make the current invention, certain criteria must be kept in mind. Specifically, the outer dimensions of the standard container will be dictated by laws relating to highway usage if it is to be transported by a land vehicle.

Typically, such standard containers will have a width W of approximately 8 feet, the length L may vary from as little as 18 to as much as 40 feet. The height H generally will be from about 8 to 10 feet. In addition, the maximum weight of the container and cargo cannot exceed those limits set by the governmental bodies which regulate the roads over which the container must travel. Typically, a gross weight of 80,000 pounds (tractor, trailer and contents) is a maximum acceptable weight in most states. The gross weight limit in turn restricts the maximum weight of cargo which can be placed in the container of the present invention to about 45,000 pounds.

While the preferred embodiment of the invention has been described and alternative configurations have been suggested, it should be understood that other embodiments may be devised and modifications can be made thereto without departing from the spirit of the invention and the scope of the appended claims.

What is claimed is:

1. A transportable intermodal cargo container for transporting bulk volumes of a solid or liquid cargo, said container comprising:

a) a substantially rectangular floor member having a length of from about 19 feet to about 21 feet and a width from about 7 feet, 9 inches to about 8 feet, 3 inches;

b) a substantially rectangular roof member:

i) having substantially the same overall dimensions as said floor member; and ii) wherein at least one four-sided opening is defined by portions of said roof member for the introduction of said cargo, said opening having a width from about 6 feet to about 8 feet and a depth from about 4 feet to about 7 feet;

c) at least one support channel fixedly attached to said roof member or integral thereto extending across at least a portion of the width of said roof member, for increasing the structural strength of said roof member;

d) wall members extending between said floor member and said roof member, said wall members having lengths substantially the same as said floor member and having a height from about 77 inches to about 79 inches;

e) wherein said floor member, roof member, and wall members are fixedly attached by continuous-seal welds along the entire perimeter of said floor member, roof member, and wall members;

f) said floor member, roof member, and wall members defining an enclosure having a volume from about 21 cubic yards to about 24 cubic yards;

g) a four-sided hatch member for each of said openings in said roof member for sealing said openings:

i) said hatch member having a width and depth not less than the width and depth of said opening in said roof member; and ii) wherein one edge portion of said hatch member is pivotably attached to one edge portion of said opening in said roof member;

h) at least one rigid elongated arm member having first and second end portions, wherein said first end portion is fixedly attached to the edge portion of said hatch means which is pivotably attached to one edge portion of said opening in said roof member;

i) a helical tension spring member having two end portions, for bearing at least a portion of the weight of said hatch member when opening and closing said hatch member:

i) wherein one end portion of said spring member is fixedly attached to said second end portion of said arm members; and ii) wherein the opposite end portion of said spring member is fixedly attached to said roof member in a configuration resulting in said spring member bearing at least a portion of the weight of said hatch member when opening and closing said hatch member;

j) hatch-member attachment means attached to said roof member or hatch member for maintaining said hatch member in a closed position;

k) first flexible gasket member disposed around the perimeter of the side of said hatch member most proximate to said roof member for preventing leakage of said cargo out of said hatch member when closed;

l) four-sided door member located in one of said end wall members for the removal of said cargo; said door member having a width from about 7 feet, 9 inches to about 8 feet, 3 inches and a height from about 77 inches to about 79 inches;

m) latch member fixedly attached to a central portion of said door member for sealing said door member when said door member is in a closed position; wherein said latch member comprises an extendible wedge member for engagement with a portion of said wall member immediately adjacent to said door member;

n) second flexible gasket member disposed around the perimeter of the side of said door member most proximate to said wall member, for preventing leakage of said cargo out of said door member when said door member is in a closed position;

o) attachment means fixedly attached to, or integral to, said floor member, disposed on an end of said container opposite the end of said container incorporating said door member, for removable attachment to a vehicle;

p) a plurality of substantially vertical integral rib members in said wall members for adding structural strength to said wall members;

q) at least one pressure fitting means in said floor, roof, or wall members for removable attachment to a pressure testing line;

r) at least one pressure release/vacuum breaker device fixedly attached to said roof member for releasing any excess pressure and reducing any excess vacuum in said container;

s) an elongated stacking bar fixedly attached, or integral to, each lengthwise end of said roof member, for providing a surface for stacking two or more containers on one another;

i) wherein each stacking bar member extends across substantially the full-width of said roof member; and ii) wherein each stack bar member is elevated from said roof member above said hatch member and hatch-member-attachment means;

t) at least two wheel members rotatably attached to said floor member at the end of said container proximate to said door member, for rolling the end of said container proximate to said door member along a surface on which the container rests when the opposite end of said container is attached by said attachment means to a vehicle;

u) wherein the sides of said floor member, roof member, and wall members proximate to the enclosure formed by said floor member, roof member, and wall members are layered with a fluid-impervious synthetic material; and v) wherein said floor member, roof member, wall members, first gasket member, hatch member, four-sided door member, second-gasket member, latch means, pressure release/vacuum breaker device, pressure fitting means are adapted and are sufficiently strong so that when pressurized said container is capable of maintaining not less than about 3 psig for not less than 5 minutes.

2. A transportable cargo container for transporting a bulk volumes of a solid or liquid cargo, which container comprises:

a) a substantially rectangular floor member;

b) a substantially rectangular roof member:

i) having substantially the same dimensions as said floor member; and ii) wherein at least one opening is defined by portions of said roof member for the introduction of said cargo;

c) at least one support channel fixedly attached to said roof member or integral thereto extending across at least a portion of the width of said roof member, for increasing the structural strength of said roof member;

d) wall members extending therebetween having lengths substantially the same as said floor member and having a substantially equal heights;

e) wherein said floor member, roof member, and wall members are fixedly attached by continuous-seal welds along the entire perimeter of said floor member, roof member, and wall members;

f) said floor member, roof member, and wall members defining an enclosure;

g) a hatch member for each of said openings in said roof member for sealing said openings:

i) said hatch member having a width and depth not less than the width and depth of said opening in said roof member; and ii) wherein one edge portion of said hatch means is pivotably attached to one edge portion of said opening in said roof member;

h) hatch member attachment means attached to said roof member or hatch member for maintaining said hatch member in the closed position;

i) flexible gasket means disposed around the perimeter of the side of said hatch means most proximate to said roof member for preventing leakage of said cargo out of said hatch means when closed;

j) door means located in one of said end wall members for the removal of said cargo;

k) latch means fixedly attached to a central portion of said door means for sealing said door means; wherein said latch means comprises an extendible wedge member for engagement with a portion of said wall member immediately adjacent to said door means;

l) flexible gasket means disposed around the perimeter of the side of said door means most proximate to said wall member, for preventing leakage of said cargo out of said door means when said door means is in the closed position;

m) at least one pressure fitting means in said floor, roof, or wall members for removable attachment to a pressure testing line; and n) at least one pressure release/vacuum breaker device fixedly attached to said roof member for releasing any excess pressure and reducing any excess vacuum in said container.

3. The container of claim 2:

a) further comprising a plurality of substantially vertical integral rib members in said wall members for adding structural strength to said wall members; and b) wherein said container is so configured so that when pressurized it is capable of maintaining not less than about 3 psig for not less than 5 minutes.

4. The container of claim 2 wherein said outer container further includes an epoxy layered on the inner portions of said floor member, roof member, and wall members.

5. The container of claim 2, further comprising an attachment means adjacent said floor member on an end of said container opposite the end incorporating said door means, for removable attachment to a vehicle for transporting said container to another location.

6. The container of claim 2, further comprising:

a) at least one rigid elongated arm member having first and second end portions, wherein said first end portion is fixedly attached to the edge portion of said hatch means which is pivotably attached to one edge portion of said opening in said roof member; and b) a helical tension spring member having two end portions, for bearing at least a portion of the weight of said hatch member when opening and closing said hatch member:

i) wherein one end portion of said spring member is fixedly attached to said second end portion of said arm members; and ii) wherein the opposite end portion of said spring member is fixedly attached to said roof member in a configuration resulting in said spring member bearing at least a portion of the weight of said hatch member when opening and closing said hatch member.

7. A method of transporting a solid or fluid cargo in a commercial land-sea shipping container designed for shipment of cargo, said method comprising:

a) providing a container comprising:

i) a substantially rectangular floor member having a length of from about 12 feet to about 30 feet and a width from about 4 feet to about 12 feet;

ii) a substantially rectangular roof member:

a) having substantially the same dimensions as said floor member; and b) wherein at least one four-sided opening is defined by a portion of said roof member for the introduction of said cargo, said opening having a width from about 5 feet to about 14 feet and a depth from about 2 feet to about 11 feet;

iii) at least one support channel fixedly attached to said roof member or integral thereto extending across at least a portion of the width of said roof member, for increasing the structural strength of said roof member;

iv) wall members extending therebetween having lengths substantially the same as said floor member and having a height from about 40 inches to about 110 inches;

v) wherein said floor member, roof member, and wall members are fixedly attached by continuous-seal welds along the entire perimeter of said floor member, roof member, and wall members;

vi) wherein said floor member, roof member, and wall members define an enclosure for containing said cargo;

vii) a four-sided hatch member for each of said openings in said roof member for sealing said openings:

a) said hatch member having a width and depth not less than the width and depth of said opening in said roof member; and b) wherein one edge portion of said hatch member is pivotably attached to one edge portion of said opening in said roof member;

viii) at least one rigid elongated arm member having first and second end portions, wherein said first end portion is fixedly attached to the edge portion of said hatch means which is pivotably attached to one edge portion of said opening in said roof member;

ix) a helical tension spring member having two end portions, for bearing at least a portion of the weight of said hatch member when opening and closing said hatch member:

a) wherein one end portion of said spring member is fixedly attached to said second end portion of said arm members; and b) wherein the opposite end portion of said spring member is fixedly attached to said roof member in a configuration resulting in said spring member bearing at least a portion of the weight of said hatch member when opening and closing said hatch member;

x) hatch-member attachment means attached to said roof member or hatch member for maintaining said hatch member in a closed position;

xi) first flexible gasket member disposed around the perimeter of the side of said hatch member most proximate to said roof member for preventing leakage of said cargo out of said hatch member when closed;

xii) four-sided door member located in one of said end wall members for the removal of said cargo; said door member having a width from about 4 feet to about 12 feet and a height from about 40 inches to about 110 inches;

xiii) latch member fixedly attached to a central portion of said door member for sealing said door member when said door member is in a closed position; wherein said latch member comprises an extendible wedge member for engagement with a portion of said wall member immediately adjacent to said door member;

xiv) second flexible gasket member disposed around the perimeter of the side of said door member most proximate to said wall member, for preventing leakage of said cargo out of said door member when said door member is in a closed position;

xv) attachment means fixedly attached to, or integral to, said floor member, disposed on an end of said container opposite the end of said container incorporating said door member, for removable attachment to a vehicle;

xvi) a plurality of substantially vertical integral rib members in said wall members for adding structural strength to said wall members;

xvii) at least one pressure fitting means in said floor, roof, or wall members for removable attachment to a pressure testing line;

xviii) at least one pressure release/vacuum breaker device fixedly attached to said roof member for releasing any excess pressure and reducing any excess vacuum in said container;

xix) an elongated stacking bar fixedly attached, or integral to, each lengthwise end of said roof member, for providing a surface for stacking two or more containers on one another;

a) wherein each stacking bar member extends across substantially the full-width of said roof member; and b) wherein each stack bar member is elevated from said roof member above said hatch member and hatch-member-attachment means;

xx) at least two wheel members rotatably attached to said floor member at the end of said container proximate to said door member, for rolling the end of said container proximate to said door member along a surface on which the container rests when the opposite end of said container is attached by said attachment means to a vehicle;

xxi) wherein the sides of said floor member, roof member, and wall members proximate to the enclosure formed by said floor member, roof member, and wall members are layered with a fluid-impervious synthetic materials;

xxii) said tank having overall dimensions to ensure that said enclosure will have a volume which, when filled to maximum capacity with said cargo, will have a total weight less than a maximum highway transportable weight;

xxiii) wherein said floor member, roof member, wall members, first gasket member, hatch member, four-sided door member, secondgasket member, latch means, pressure release/vacuum breaker device, pressure fitting means are adapted and are sufficiently strong so that when pressurized said container is capable of maintaining not less than about 3 psig for not less than 5 minutes;

b) filling said container to desired level with said cargo;

c) closing said container; and d) transporting said container by a transport vehicle to another location.

8. The method of claim 7 wherein the tare weight of said container is from about 5000 pounds to about 12000 pounds.

9. A method of claim 7 wherein said floor member, roof member, and wall members define an enclosure having a volume from about 20 cubic yards to about 32 cubic yards.

10. The method of claim 7 wherein said cargo is selected from the group consisting of spent catalyst, crude-oil-tank bottoms, primary-oil/water-solids-separator sludge, and mixtures thereof.

11. A method of transporting a solid or fluid cargo in a shipping container designed for shipment of cargo, said method comprising:

a) providing a container comprising:

i) a substantially rectangular floor member;

ii) a substantially rectangular roof member:

a) having substantially the same dimensions as said floor member; and b) wherein at least one opening is defined by portions of said roof member for the introduction of said cargo;

iii) at least one support channel fixedly attached to said roof member or integral thereto extending across at least a portion of the width of said roof member, for increasing the structural strength of said roof member;

iv) wall members extending therebetween having lengths substantially the same as said floor member and having substantially equal heights;

v) wherein said floor member, roof member, and wall members are fixedly attached by continuous-seal welds along the entire perimeter of said floor member, roof member, and wall members;

vi) said floor member, roof member, and wall members defining an enclosure;

vii) a hatch member for each of said openings in said roof member for sealing said openings:

a) said hatch member having a width and depth not less than the width and depth of said opening in said roof member; and b) wherein one edge portion of said hatch means is pivotably attached to one edge portion of said opening in said roof member;

viii) hatch member attachment means attached to said roof member or hatch member for maintaining said hatch member in the closed position;

ix) flexible gasket means disposed around the perimeter of the side of said hatch means most proximate to said roof member for preventing leakage of said cargo out of said hatch means when closed;

x) door means located in one of said end wall members for the removal of said cargo;

xi) latch means fixedly attached to a central portion of said door means for sealing said door means; wherein said latch means comprises an extendible wedge member for engagement with a portion of said wall member immediately adjacent to said door means;

xii) flexible gasket means disposed around the perimeter of the side of said door means most proximate to said wall member, for preventing leakage of said cargo out of said door means when said door means is in the closed position;

xiii) at least one pressure fitting means in said floor, roof, or wall members for removable attachment to a pressure testing line; and xiv) at least one pressure release/vacuum breaker device fixedly attached to said roof member for releasing any excess pressure and reducing any excess vacuum in said container;

b) filling said container to desired level with said cargo;

c) closing said container; and d) transporting said container by a transport vehicle to another location.

12. The container of claim 11, further comprising a plurality of substantially vertical integral rib members in said wall members for adding structural strength to said wall members.

13. The container of claim 11 wherein said outer container further includes an epoxy layered on the inner portions of said floor member, roof member, and wall members.

14. The container of claim 11, further comprising an attachment means adjacent said floor member on an end of said container opposite the end incorporating said door means, for removable attachment to a vehicle for transporting said container to another location.

15. The container of claim 11, further comprising:

a) at least one rigid elongated arm member having first and second end portions, wherein said first end portion is fixedly attached to the edge portion of said hatch means which is pivotably attached to one edge portion of said opening in said roof member; and b) a helical tension spring member having two end portions, for bearing at least a portion of the weight of said hatch member when opening and closing said hatch member:

i) wherein one end portion of said spring member is fixedly attached to said second end portion of said arm members; and ii) wherein the opposite end portion of said spring member is fixedly attached to said roof member in a configuration resulting in said spring member bearing at least a portion of the weight of said hatch member when opening and closing said hatch member.

16. The method of claim 11 wherein the tare weight of said container is from about 7900 pounds to about 8100 pounds.

17. A method of claim 11 wherein the overall dimensions of said floor member, roof member, and wall members are selected to ensure they form an enclosure having a volume from about 20 cubic yards to about 32 cubic yards.

18. The method of claim 11 wherein said cargo is selected from the group consisting of spent catalyst, crude-oil-tank bottoms, primary-oil/water-solids-separator sludge, and mixtures thereof.

* * * * *